United States Patent [19]

Khodosh et al.

[11] 4,222,681

[45] Sep. 16, 1980

[54] SHIELD FOR CONSTRUCTING TUNNELS WITH IN-SITU FORMED CONCRETE LINING

[76] Inventors: Vladimir A. Khodosh, M. Pirogovskaya ulitsa, 27, korpus 1, kv. 11; Valentin A. Ivanov, ulitsa Konstantinova, 4, kv. 25; Anatoly S. Lugovtsov, Scherbakovskaya ulitsa, 8/12, kv. 28; Vladimir A. Alikhashkin, ulitsa Gilyarovskogo, 33, kv. 69, all of Moscow; Arkady I. Mozhaev, mikroraion Serebryanka, 3, kv. 50, Pushkino, Moskovskaya oblast; Sergei N. Vlasov, Rizhsky proezd, 9, kv. 26, Moscow; Alexei K. Kartsev, Yasinovataya, ulitsa B Khmelnitskogo, 12, Donetskaya oblast; Iosif D. Y. Fishman, Yasinovataya, ulitsa Mashinostroitelei, 13, kv. 20, Donetskaya oblast; Ivan N. Grigoriev, Yasinovataya, ulitsa Mashinostroitelei, 7, kv. 6, Donetskaya oblast, all of U.S.S.R.

[21] Appl. No.: 949,740

[22] Filed: Oct. 10, 1978

[51] Int. Cl.[2] ..... E01G 3/04; E21D 11/10

[52] U.S. Cl. ..... 405/141; 405/146

[58] Field of Search ..... 405/138, 140, 141, 142, 405/143, 145, 150, 151; 299/31, 33

[56] References Cited

U.S. PATENT DOCUMENTS

| | | | |
|---|---|---|---|
| 3,350,889 | 11/1967 | Sturm | 405/143 |
| 3,372,553 | 3/1968 | Samoilov et al. | 405/141 |
| 3,379,024 | 4/1968 | Wohlmeyer | 405/143 X |
| 3,561,223 | 2/1971 | Tabor | 405/146 X |

FOREIGN PATENT DOCUMENTS

| | | | |
|---|---|---|---|
| 2550050 | 5/1977 | Fed. Rep. of Germany | 405/141 |

*Primary Examiner*—Dennis L. Taylor
*Attorney, Agent, or Firm*—Steinberg & Blake

[57] ABSTRACT

The proposed shield comprises in its frame a drive for advancing the shield along a path, a device for absorbing the thrust force from the drive and transmitting it to concrete in the process of its being pressed, a forming unit for forming the inner surface of a concrete lining, which, according to the invention, includes a former mounted coaxially in the shield frame and adapted to move by a drive along the shield longitudinal axis, and a supporting structure installed rearwardly of the former and adapted to move along the longitudinal axis of the concrete lining. The present invention will be most advantageously used in sand or unstable soil, where it makes possible to drive a tunnel practically without setting the earth surface and to preserve overground buildings situated close to the tunnel construction area. The present invention prevents the concrete lining from cracking in the process of its being formed.

3 Claims, 7 Drawing Figures

SHIELD FOR CONSTRUCTING TUNNELS WITH IN-SITU FORMED CONCRETE LINING

TITLE OF THE INVENTION

I. Field of the Invention

The present invention relates to the construction of underground structures and more particularly to shields for constructing tunnels with an in-situ formed concrete lining, which can be most advantageously used in the construction of tunnels and underground.

The invention can be utilized in sand or unstable soil where it makes possible to drive a tunnel practically without setting of the earth surface and to preserve overground buildings situated close to the tunnel construction area.

II. Background of the Invention

The prior art knows a shield for constructing tunnels with an in-situ concrete lining.

The frame of the shield is provided with horizontal splitting platforms and incorporates a drive for advancing the shield along a defined path, a device namely, a pressing ring for absorbing the thrust force from the drive and transmitting it to concrete in the process of its being pressed, and a forming unit for forming the inner surface of a concrete lining, which is a removable sectional form. This form consists of separate collapsible form panels, which, as the shield advances along a path, are dismantled rearwardly of the shield, folded and moved closer to the rear side of the shield and mounted again for concreting the next portion of the lining.

Concrete for forming a lining is introduced into the space between a shield casing and said form panels secured to the previously formed lining portions. Pressing of concrete is accomplished as the shield is advanced by a drive whose thrust force is transmitted to the concrete. In the advancement of the shield its longitudinal axis, as a rule, is deflected from the direction of the longitudinal axis of the lining being formed not only along the curved but also along the straight lengths of the tunnel path.

Upon completion of a lining portion a circular butt joint always falls in the middle zone of the form panel, so for every cycle concrete is introduced into the space defined both by the next mounted form panel and partly by the previously mounted one.

As the concrete is being pressed its side pressure acts not only on a successively mounted form panel but also on a part of the previously mounted one, supporting the lining during the setting and hardening the the concrete. The deformation of this panel has a detrimental effect on the lining, thereby causing its cracking.

Moreover, as it has been hereinbefore mentioned, the direction of the advancement of the shield causes the misalignment of the shield is often deflected from the direction of its longitudinal axis, both intentionally (when a curved tunnel is being formed) and unintentionally. This deflection and lining axes and, consequently, of the form panels aligned with the lining. As a result, when the pressing ring is drawn up along the shield axis to its initial position upon completion of the pressing process, it often moves the last form panel with a freshly filled concrete from its position, which results in additional circular cracking. These disadvantages, therefore, prevent the obtainment of a watertight tunnel lining and make it difficult to control the shield.

III. Summary of the Invention

An object of the present invention is to provide a shield for the construction of tunnels with an in-situ formed concrete lining, which would eliminate cracking of the concrete lining.

Another object of the present invention is to provide a shield which would ensure a watertight tunnel lining.

These and other objects are obtained by a shield for constructing tunnels having an in-situ formed concrete lining, comprising a frame, a drive incorporated in said frame for advancing the shield along a defined path, a device for absorbing the thrust force from the drive and transmitting it to concrete when it is being pressed, a forming unit for forming the inner surface of the concrete lining, including a former mounted coaxially in the shield frame in a manner such that it will deflect from the direction of the longitudinal axis together with the shield frame during the pressing process and to be further advanced along the shield longitudinal axis upon completion of the pressing of a given portion and a supporting structure mounted rearwardly of said former and adapted to be displaced along the lining longitudinal axis.

The coaxial arrangement of the former mounted movably with respect to the shield longitudinal axis prevents the concrete from detrimental effects of the shield and eliminates cracking in the lining. Moreover, this improves the manoeuvrability of the shield.

It is advisable to mount the former on a bracket which itself is secured to the shield frame and carrying supporting elements for the former to be mounted and displaced thereon.

This arrangement of the former provides and maintains the coaxial relationship of the former with respect to the shield frame at any turning angle of the latter; i.e., despite any deflection from the direction of the longitudinal axis of the shield frame while the shield frame advances along the path the displacement of the former along the shield frame axis.

It is advisable to mount the support elements on a bracket said elements being adapted to be adjusted radially with respect to the frame.

Such an arrangement provides for the alignment of the former and the shield frame while installing and adjusting it.

It is advisable to connect the former with the supporting structure by means of hydraulic jacks, their cylinders being pivotally connected to the former and their piston-rods, to the supporting structure.

Such a connection makes it possible for the supporting structure to be displaced together with the former, provides the freedom for the relative angular movements of said structure and former arising during the advancement of the shield, and allows the former to be moved forward with the supporting structure remaining stationary for the purpose of inspecting the face end of a formed portion, as well as inspecting and lubricating the outer former surface.

IV. Brief Description of the Drawings

The invention will now be described in greater detail with reference to a preferred embodiment, taken in conjunction with the accompanying drawings, wherein.

V. Detailed Description of the Invention

Figure 1:
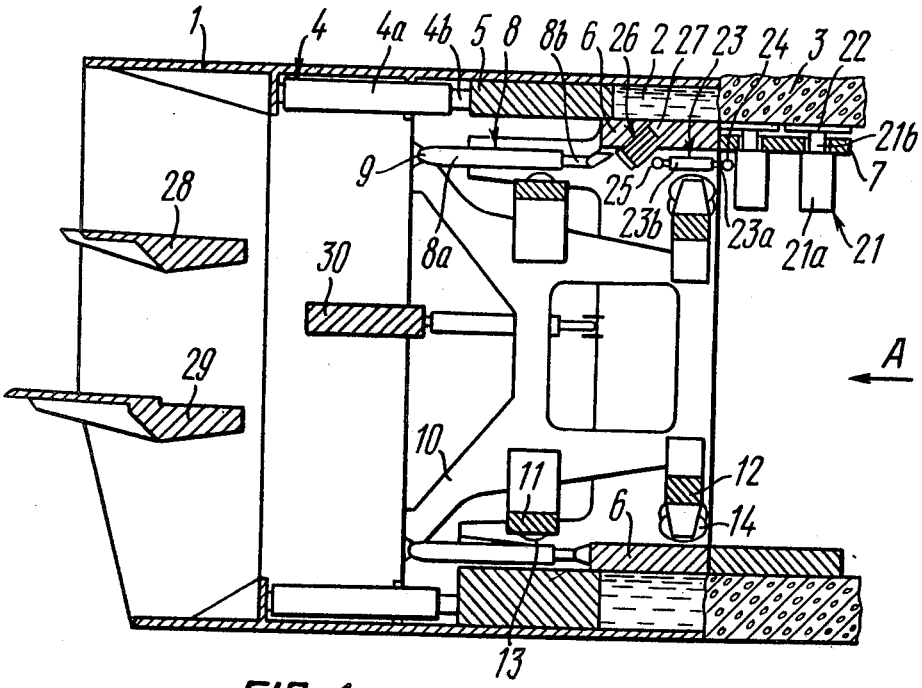
FIG. 1 shows a longitudinal sectional view of the shield for constructing tunnels with an in-situ formed lining, according to the invention.

FIG. 1 shows the proposed shield for constructing tunnels with an in-situ former concrete lining, comprising a circular frame 1 which incorporates a drive for advancing the shield along a defined path, a device for absorbing the thrust force of the drive and transmitting it to concrete 2 in the process of its being pressed, and a forming unit for forming the inner surface of a concrete lining 3.

The drive for advancing the shield consists of a number of hydraulic rams 4 installed in the bores over the periphery of said frame 1. Cylinders 4*a* of the hydraulic rams 4 are secured in the frame 1, while piston-rods 4*b* are firmly brought against the device for absorbing the thrust force and transmitting it to the concrete 2 in the process of its being pressed. The device has the form of either a whole or a split ring 5.

Figure 2:
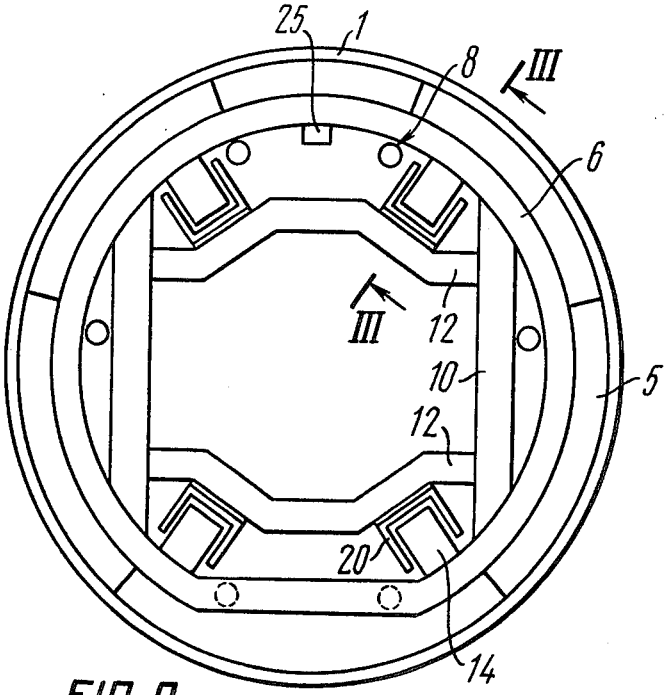
FIG. 2 is the same view taken along the line A in FIG. 1.

According to the invention, the forming unit comprises a former 6 coaxially mounted in the shield frame and adapted to turn together with the frame during the pressing process and be displaced by a self-contained drive along the shield longitudinal axis upon completion of the pressing of a given portion, and a supporting structure 7 arranged to move rearwardly of said former 6 along the longitudinal axis of the lining 3. The former 6 has the shape of a short cylinder having a flat cut on its underside (FIG. 2). The shape of the outer surface of the former 6 provides for the specified cross-sectional form of the concrete lining 3.

The advancement of the former 6 is provided positively by a drive which, in this case, is a system of hydraulic jacks 8. Hinges 9 are fitted to the bottom of a cylinder 8*a* of each of the hydraulic jacks 8 and to its piston-rod 8*b*. The cylinder 8*a* of each of the hydraulic jacks 8 is articulated to the shield frame 1 and the piston-rod 8*b* is also articulated to the former 6.

Figure 3:
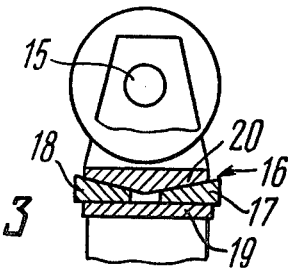
FIG. 3 is a sectional view taken along the line III—III in FIG. 2.

A bracket 10 is secured on the shield frame 1 the bracket having cross beams 11 and 12 (FIG. 2) which carry support elements 13 (FIG. 1) and 14 (FIG. 2), respectively. These support elements 13 and 14, in the specific case, are rollers mounted on axles 15 (FIG. 3). The former 6 is installed on the support elements 13 and 14 disposed in two parallel planes perpendicular to the shield axis. In this manner, it is seen that the former 6 will always be maintained in a coaxial relationship with respect to the shield frame although it can be moved in the axial direction with respect thereto.

The support elements 13 and 14 are mounted on the cross-beam 11 and 12 of the bracket 10 and are adapted to be radially adjusted with respect to the shield body 1. The adjustment is effected by a wedging mechanism 16. In this particular case, the wedging mechanism 16 consists of two oppositely directed wedges 17 and 18 installed on a flat bottom 19 provided on the cross-beams 11 and 12 of the bracket 10, a base 20 of the roller support elements 13 and 14 being mounted with its two-way bevelled surface on the wedges 17 and 18. By bringing the wedges 17 and 18 together or by moving them apart a radial displacement of the rollers is accomplished.

Installed behind the former 6 is supporting structure 7 having a self-contained drive for its being displaced along the lining longitudinal axis. In this case, the supporting structure is a circular member carrying radially disposed hydraulic jacks 21 (FIG. 1). Cylinders 21*a* of the hydraulic jacks 21 are attached to the supporting structure 7 while the ends of piston-rods 21*b* of the jacks are fitted with form panels 22 being pressed against the formed lining 3 by the force exerted by the jacks 21. The form panels 22 are made as shells curved to fit the profile of the surface of the inner lining 3.

The supporting structure 7 is connected to the former 6 by means of hydraulic jacks 23 to provide for the displacement thereof along the longitudinal axis of the lining 3. Piston-rod 23*a* of the jack 23 is fitted with a hinge 24, and a hinge 25 is attached to the bottom of a cylinder 23*b*. The hinge 24, in turn, is attached to the supporting structure 7 and the hinge 25, to the former 6. The hydraulic jacks may be arranged in a reverse position as well.

To deliver the concrete 2 provision is made in the formers 6 for a conduit 26 having a plugging device 27. The plugging device 27 may be of different constructional arrangements. In this particular case, it is provided as a cylindrical plug to be inserted into the conduit 26 after removal of the concrete pump delivering concrete into the space defined by the former. The top of the plug is shaped so as to suit the cylindrical shape of the outer former surface and is fitted flush with the latter.

Installed in the shield frame 1 are horizontal partitioning platforms 28 and 29 for improving the rigidity of the frame 1 and its cutting unit and for dividing, for example, a sand face into horizonal sections and forming sand slopes to maintain the equilibrium of the working face. In the abutment part of the frame 1 there is installed a platfrom 30 for improving the rigidity of the shield frame 1 and for accommodating the equipment inside the shield.

Rearwardly of the shield there is shown a completed in-situ formed concrete lining 3, which is a solid ring firmly pressed against the surrounding ground, its inner surface corresponding to the specified shape of a tunnel with a flat lower part.

The shield according to the invention functions as follows.

Figure 4:
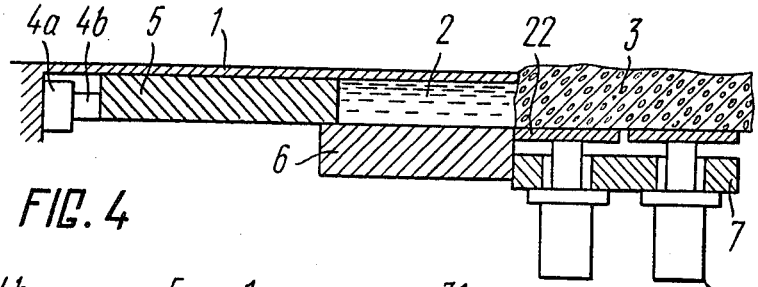
FIG. 4 shows the positioning of the shield units before the beginning of the concrete pressing process.

The forming unit and its former 6 are installed with respect to the shield frame 1 in the position shown in FIG. 4.

Figure 5:
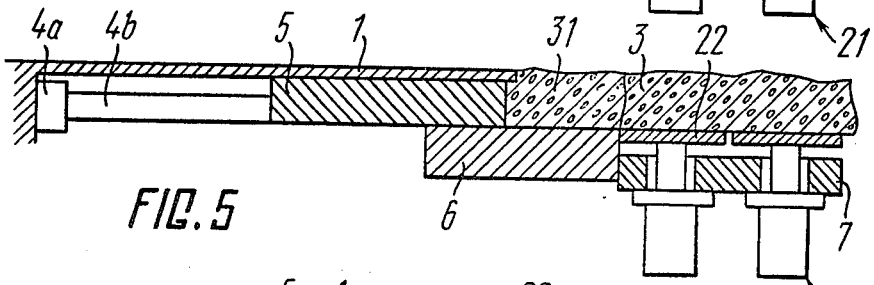
FIG. 5 shows the same view upon completion of the pressing process and displacement of the shield for a next advance.

In this position the concrete 2 is fed into the space defined by the frame 1, the former 6, the ring 5 and the formed lining 3, through the conduit 26. After said space is filled up, the conduit 26 is closed with the plug 27 and the drive 4 of the shield is put on. The shield moves forward, overcoming the ground resistance of the working face and the friction of the surrounding ground. The thrust force of the drive 4 acts on the ring 5 pressing the concrete 2 and displacing it outside the shield frame 1, as is shown in FIG. 5.

During the process the former 6 remains coaxial by virtue of its being mounted on the bracket 10 in the manner described above, which bracket is secured to the shield frame 1 and will be deflected from the direction of the shield frame axis upon the direction of movement of the shield frame being so deflected.

Thus, by virtue of the former being mounted in the bracket 10, the latter being secured to the shield frame 2 the longitudinal axis of the finished portion of the lining of the tunnel 31 is always aligned with that of the shield frame. The end face of the previously formed lining 3 is always left outside the former 6, so that the latter cannot have a detrimental effect on the concrete being set, thereby eliminating the cause of cracking in the lining.

Figure 6:
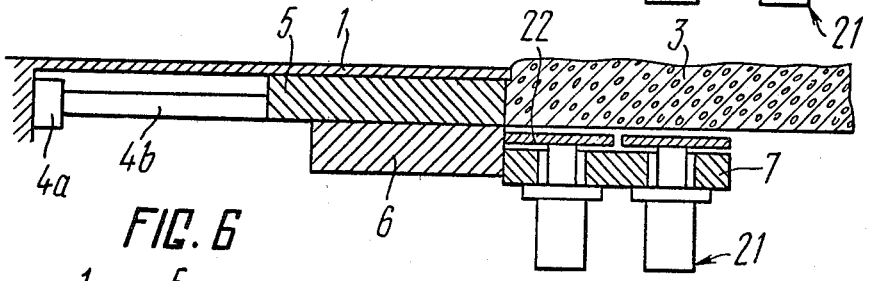
FIG. 6 is the same view after the former resumes its initial position.

Upon completion of the pressing (FIG. 5) the former is drawn up by the drive 8 into the shield frame 1 assuming its initial position, pulling up the support part by the jacks 23 (FIG. 6).

The plates 22 first release the pressure on the lining 3, by the end of the displacement of the plates 22 the pressure on the lining 3 being restored.

As the former 6 and the supporting structure 7 are displaced the ring 5 is remained pressed to the end face of the finished portion of the tunnel 31.

After the displacement of the former 6 together with the supporting structure 7, the plates 22 being pressed to the lining 3, the ring 5 is drawn up into the shield frame 1.

Figure 7:
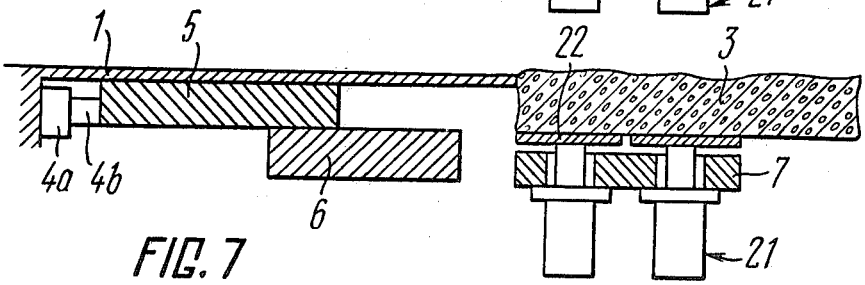
FIG. 7 shows the position of the shield units for inspection of the concrete lining end face, cleaning and lubrication of the outside former surface.

Provision is made for the inspection of the finished lining end face and lubrication of the outside surface of the former 6 by moving the latter by the drive 8 into the position shown in FIG. 7, the supporting structure remaining stationary, and the piston-rod **23*b* of the jack 23 does not prevent the former 6** from being moved forward.

The invention enables one to obtain the construction of a watertight tunnel structure, to speed up the process of constructing tunnels with an in-situ formed concrete lining by the elimination of manual labour used for dismantling and moving of form panels in known apparatus, to improve the control of the shield advancement and to minimize the turn radius at curved lengths of a path, to decrease the mass of the shield, the system of auxiliary units being included.

What is claimed is:

1. A shield for the construction of tunnels with an in-situ formed concrete lining, comprising: a frame having a longitudinal axis; drive means operatively associated with and located within said frame for advancing said shield along a defined path; means operatively associated with and located within said frame for absorbing the thrust force of said drive means and for transferring the thrust force to the concrete during the process of its compaction; an inner support located with said frame and rigidly secured thereto; and a forming unit mounted on said inner support for molding the inner surface of the concrete lining, said forming unit including a former which is coaxially mounted within said frame and at least one hydraulic jack interconnecting said frame and said former in a manner such that the former can move in the axial direction within and relative to said frame, and such that the coaxial relationship of the former and the frame is constantly maintained by virtue of the mounting of the former unit on said inner support which is secured to said frame.

2. A shield as recited in claim 1 wherein said inner support member comprises a bracket and support members associated therewith, said forming unit being mounted on said support members such that the coaxial relationship of the former and the frame is constantly maintained and such that the former can move in the axial direction within and relative to said frame.

3. A shield as claimed in claim 2, wherein said support elements are mounted on said bracket and means for adjusting said support said support elements radially with respect to said shield frame.

* * * * *